United States Patent [19]

Bradley et al.

[11] 4,280,173

[45] Jul. 21, 1981

[54] HEAT SHIELD FOR PLASTIC HEADLAMP

[75] Inventors: Irving Bradley, Novelty; Vincent Vodicka, South Euclid, both of Ohio

[73] Assignee: General Electric Company, Schenectady, N.Y.

[21] Appl. No.: 916,490

[22] Filed: Jun. 19, 1978

[51] Int. Cl.[3] ..... F21V 7/20

[52] U.S. Cl. ..... 362/294; 362/296; 362/345; 313/113

[58] Field of Search ..... 362/61, 218, 264, 294, 362/345, 373, 296, 329, 359, 214, 302, 303; 313/25, 33, 38, 44, 113, 231, 42, 114, 116, 117; 353/56; 352/202

[56] References Cited

U.S. PATENT DOCUMENTS

| | | | |
|---|---|---|---|
| 1,274,217 | 7/1918 | Trenner | 362/214 |
| 1,448,675 | 3/1923 | Pitschman | 362/303 |
| 1,675,731 | 7/1928 | Schofield | 362/303 |
| 1,760,055 | 5/1930 | Graves | 362/303 |
| 1,782,629 | 11/1930 | Pape | 362/303 |
| 2,089,388 | 8/1937 | Lindstrom | 352/202 |
| 2,592,102 | 4/1952 | Alexander | 313/117 |
| 2,876,375 | 3/1959 | Marsh | 313/117 |
| 2,909,696 | 10/1959 | Cooper | 313/113 |
| 3,136,914 | 6/1964 | Jayne et al. | 362/214 |
| 3,343,021 | 9/1967 | Burnett et al. | 313/42 |
| 3,553,520 | 1/1971 | Hicks | 313/113 |
| 3,569,693 | 3/1971 | Leonberg | 313/113 |
| 3,806,236 | 4/1974 | Downing | 362/294 |
| 4,029,985 | 6/1977 | Rachel | 313/117 |

FOREIGN PATENT DOCUMENTS

| | | | |
|---|---|---|---|
| 2509318 | 11/1975 | Fed. Rep. of Germany | 362/303 |
| 2303305 | 1/1976 | France | 362/303 |
| 1123574 | 8/1968 | United Kingdom | 313/117 |

*Primary Examiner*—L. T. Hix
*Assistant Examiner*—Alan Mathews
*Attorney, Agent, or Firm*—Sidney Greenberg; Lawrence R. Kempton; Philip L. Schlamp

[57] ABSTRACT

A heat shield is disclosed for rectangular PAR lamps in which the shield is mechanically attached to the roof of the lamp by two rails into which the shield slides.

6 Claims, 5 Drawing Figures

Fig. 1
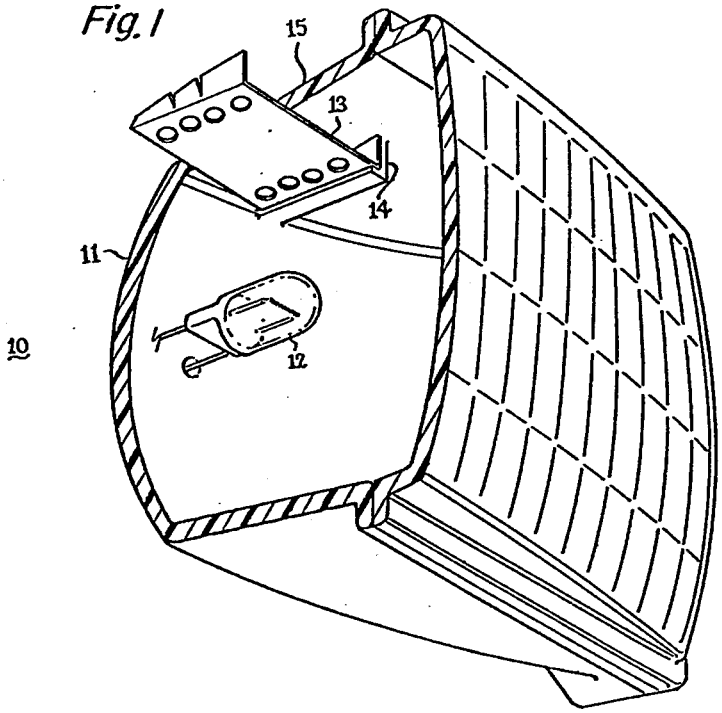
Fig. 2
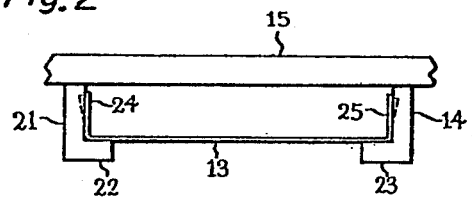
Fig. 4
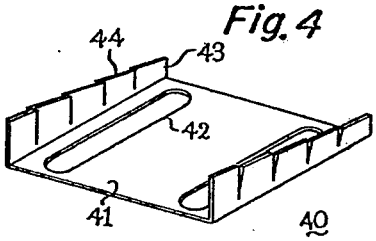
Fig. 3
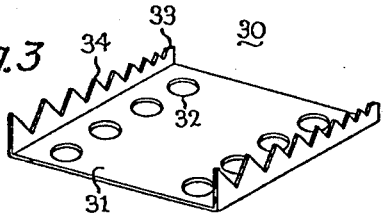
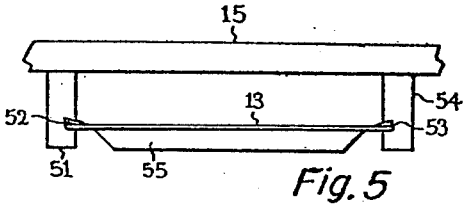
Fig. 5

HEAT SHIELD FOR PLASTIC HEADLAMP

This invention relates to reflector lamps and, in particular, to a heat shield for rectangular PAR (Parabolic Aluminized Reflector) lamps having planes intersecting the paraboloidal reflector to define top, bottom and side walls.

As disclosed in copending and commonly assigned application Ser. No. 896,707, now U.S. Pat. No. 4,210,841, an all-plastic or plastic reflector PAR lamp offers a number of advantages over all-glass designs. There is, however, the problem of the hot spot formed in the reflector above the filament. While the average temperature of the lamp may be well below the softening temperature of the plastic, the combination of direct radiation, convection heating from the filament, and high ambient temperature can combine to produce a wall temperature in the region above the filament approaching or exceeding the softening temperature of the plastic.

In the prior art, a variety of heat shields have been used in high wattage lamps to protect lamp components from the heat of the light source. Generally, these shields are welded or crimped to a lead or support wire to hold them in the desired position. In the applications where a lamp is to be subjected to vibration, such as in vehicles, attaching a mass to a lead wire is undesirable.

Fastening a shield directly to the roof of the reflector is not necessarily effective and is undesirable from a manufacturing viewpoint. Using spacer pins, adhesives, or manual assembly are similarly undesirable as unnecessarily complicating the manufacture of the lamp.

In view of the foregoing, it is therefore an object of the present invention to provide an improved heat shield for PAR lamps and, in particular, for rectangular PAR lamps comprising a plastic reflector.

Another object of the present invention is to provide an easily manufactured PAR lamp having a heat shield.

A further object of the present invention is to provide a reflector for PAR lamps having molded in features for containing a heat shield.

Another object of the present invention is to provide a heat shield which can be reliably and automatically added to a PAR lamp reflector.

A further object of the present invention is to provide a self-securing heat shield for reflector lamps.

Another object of the present invention is to provide a heat shield for reflector lamps which permits circulation of the lamp atmosphere about the shield.

The foregoing objects are achieved in the present invention wherein a reflector for a rectangular PAR lamp is provided with spaced apart L-shaped rails in the upper side or roof thereof for receiving a heat reflecting shield which slides into the rails. The edges of the shield incorporate means for frictionally engaging the rails. The shield itself is perforated to allow the atmosphere within the lamp to circulate between the shield and the roof of the reflector, thereby further cooling the hot spot and reducing heat transfer from the shield to the plastic rails.

A more complete understanding of the present invention can be obtained by considering the following detailed description in conjunction with the accompanying drawings, in which:

FIG. 1 illustrates a preferred embodiment of the present invention.

FIG. 2 is a more detailed view of a portion of FIG. 1.

FIGS. 3 and 4 are alternative embodiments of a shield in accordance with the present invention.

FIG. 5 illustrates an alternative embodiment of the rails and shield.

FIG. 1 illustrates a preferred embodiment of the present invention. Reflector 10 comprises a plastic, paraboloidal surface 11 having sides therein formed by the intersection of the planes with the paraboloid. Positioned at the focus of the paraboloid is a suitable light source, such as lamp 12. Located above lamp 12 is heat shield 13 held in place by rails 14 formed as part of roof 15. A more detailed understanding of a reflector in accordance with the present invention can be obtained by considering FIG. 2 in which the construction of the roof portion of reflector 10 is shown in detail in cross-section.

Specifically, roof 15 has L-shaped rails 14 and 21 attached thereto. The feet of each rail, 23 and 22 respectively, face each other so as to partially enclose shield 13. Shield 13 comprises a U-shaped member having sides 24 and 25 of about the same dimension as the inside height of rails 14 and 21. Shield 13 is inserted within rails 14 and 21 such that the body of the heat shield is separated from roof 15 by sides 24 and 25.

FIGS. 3 and 4 illustrate alternative embodiments of frictional means used to retain shield 13 in position and the apertures used to permit circulation of the atmosphere within the lamp between shield 13 and roof 15. As illustrated in FIG. 3, shield 30 comprises a planar portion 31 and sides such as side 33. Side 33 is cut in a sawtooth design 34 so that the shield may be easily inserted yet be difficult to remove. Further, shield 30 is provided with a plurality of apertures such as aperture 32, which enable the atmosphere within the lamp to circulate about heat shield 30. In a preferred embodiment, apertures 32 are located along the rail engaging sides of heat shield 30.

An alternative form of heat shield is illustrated in FIG. 4 wherein heat shield 40 comprises a planar portion 41 and sides 43. Apertures 42 comprise elongated slots formed adjacent the sides of heat shield 40. Sides 43 are provided with cuts 44 and a slight bending of one side of the cut portion so as to provide a frictional engagement with the rails when shield 40 is inserted in a lamp. While the cut design is illustrated in conjunction with slots 42 and the sawtooth design is illustrated in conjunction with circular holes 32, it should be understood that any combination of apertures and side designs may be incorporated in heat shields in accordance with the present invention.

In FIG. 5, rails 51 and 54 comprise a rectangular cross-section. On the inner side of each rail is longitudinal slot 52 and 53, respectively. For this embodiment, the heat shield is flat rather than having a U-shaped cross-section. Heat shield 13 also may include a flange 55. Flange 55 does not touch the reflector but extends down slightly in front of the reflector and facilitates the circulation of the atmosphere within the lamp.

The reflector, comprising paraboloidal surface 11 and rails 14 and 21, is easily molded as a single part and removed from the mold since the rails are parallel to the axis of the lamp; that is, no undercutting or special tooling is required in the molds. The release of the part may be further simplified by very slightly tapering the thickness of rails 14 and 21 along the length thereof, a technique known to those in the molding art. As appreciated by those of skill in the art, at least the paraboloidal portion of surface 11 has a specular coating (not shown) formed thereon. The shield, light source, and electrical connections are then added and a suitable lens attached, completing the lamp.

There is thus provided by the present invention an improved heat shield design in which the heat shield is not attached to the lead or support wires but is attached to the reflector directly in a manner that is mechanically simple, yet secure. The heat shield and reflector in accordance with the present invention thus alleviates the hot spot problem and do not generate problems of their own in terms of difficulty of fabrication or deterioration of vibration resistance of a lamp.

Having thus described the invention it will be apparent to those of skill in the art that various modifications can be made within the spirit and scope of the present invention. For example, while light source 12 is illustrated as an incandescent lamp, any suitable light source may be utilized.

What we claim as new and desire to secure by United States Letters Patent is:

1. A headlamp comprising, in combination, a plastic housing having a curved rear reflective wall having an optical focus, said housing having top, bottom and side walls intersecting said rear wall, a lamp arranged substantially at said optical focus, said top wall being substantially planar and having laterally spaced substantially parallel rails depending therefrom, and a heat shield comprising a substantially planar heat reflecting member held by said rails generally parallel to and spaced from said top wall and directly above said lamp for shielding said top wall from the heat produced by said lamp.

2. A headlamp as defined in claim 1, said rails being L-shaped in cross-section with bottom flanges extending toward each other, said heat shield resting on said bottom flanges.

3. A headlamp as defined in claim 2, said heat shield having aperture means along opposite edges thereof for circulation of air therethrough.

4. A headlamp as defined in claim 2, said heat shield having opposite flanges extending toward said top wall and frictionally engaging said depending rails.

5. A headlamp as defined in claim 1, said rails being integrally formed with said top wall.

6. A headlamp as defined in claim 1, said parallel rails being formed with opposed slots on their inner surfaces, said planar heat reflecting member having opposite edges respectively inserted in said opposed slots.

* * * * *